US009093051B2

(12) United States Patent
Sato et al.

(10) Patent No.: US 9,093,051 B2
(45) Date of Patent: Jul. 28, 2015

(54) SPIKED LEG, MUSICAL INSTRUMENT, AND MUSICAL INSTRUMENT STAND

(71) Applicant: HOSHINO GAKKI CO., LTD., Nagoya, Aichi (JP)

(72) Inventors: Naoki Sato, Nagoya (JP); Hideyuki Miyajima, Nagoya (JP)

(73) Assignee: HOSINO GAKKI CO., LTD, Aichi (JP)

( * ) Notice: Subject to any disclaimer, the term of this patent is extended or adjusted under 35 U.S.C. 154(b) by 126 days.

(21) Appl. No.: 13/662,559

(22) Filed: Oct. 29, 2012

(65) Prior Publication Data

US 2014/0026734 A1 Jan. 30, 2014

(30) Foreign Application Priority Data

Jul. 24, 2012 (JP) ..... 2012-163778

(51) Int. Cl.
*G10D 13/02* (2006.01)
*G10D 13/06* (2006.01)

(52) U.S. Cl.
CPC ..... *G10D 13/026* (2013.01); *G10D 13/065* (2013.01)

(58) Field of Classification Search
USPC ..... 84/421
See application file for complete search history.

(56) References Cited

U.S. PATENT DOCUMENTS

| | | | | |
|---|---|---|---|---|
| 5,408,913 | A | 4/1995 | Hoshino | |
| 6,031,170 | A * | 2/2000 | Hoshino | 84/422.3 |
| 7,834,259 | B2 * | 11/2010 | Jeffries et al. | 84/421 |
| 2005/0150356 | A1 | 7/2005 | Takegawa | |
| 2010/0186574 | A1 * | 7/2010 | Shigenaga | 84/421 |

FOREIGN PATENT DOCUMENTS

| | | |
|---|---|---|
| JP | 53-101532 U | 8/1978 |
| JP | 53-103717 U | 8/1978 |
| JP | 57-201597 U | 12/1982 |

OTHER PUBLICATIONS

Notification of Reasons for Rejection of Japanese Patent Application No.2012-163778 forwarded on Jun. 10, 2014.

* cited by examiner

*Primary Examiner* — Christopher Uhlir

(57) ABSTRACT

A spiked leg includes a first leg part and a second leg part, which are leg members, and a stopper fixed to a distal end of the second leg part. The stopper includes a stopper main body, a spike holder, and a spike. In the stopper main body, a part of the stopper main body is located between a first longitudinal hole and a second longitudinal hole. Due to this, the proximal end of the spike is arranged apart from a distal end of the second leg part when the second leg part and the spike are assembled onto the stopper.

6 Claims, 7 Drawing Sheets

SPIKED LEG, MUSICAL INSTRUMENT, AND MUSICAL INSTRUMENT STAND

BACKGROUND OF THE INVENTION

The present invention relates to a spiked leg for being attached to a musical instrument or a musical instrument stand, a musical instrument with a spiked leg, and a musical instrument stand with a spiked leg.

When a player plays a hi-hat or a bass drum, an operation pedal attached to the hi-hat stand or the bass drum is pedaled. At this occasion, depending on a pedaling force on the operation pedal, the position of the hi-hat stand or the bass drum may move away from the player than its original position. Due to this, a hi-hat stand having a spiked leg and a bass drum having a spiked leg have been proposed as configurations that fix the positions of the hi-hat stand and the bass drum.

U.S. Pat. No. 5,408,913 discloses a supporting leg structure for a bass drum. The supporting leg disclosed in U.S. Pat. No. 5,408,913 is provided with a base to be fixed to a shell, a first leg part rotationally attached to the base, a second leg part attached retractable with respect to the first leg part, and a rubber stopper fixed to the distal end of the second leg part. The bass drum is set up by causing the distal end of the second leg part formed in a spike shape to abut against a floor surface. Accordingly, the bass drum is fixed so as not to move from its original position.

U.S. Pat. No. 6,031,170 discloses a supporting leg structure for a hi-hat stand. The supporting leg disclosed in U.S. Pat. No. 6,031,170 is provided with a supporting leg main part coupled to a supporting tube via a leg plate, a spike rod housed inside the supporting leg main part, and a rubber stopper attached to the distal end of the supporting leg main part. The spike rod is supported by the supporting leg main part to be able to expose its pointed end from an opening end of the supporting leg main part. Similar to the bass drum, the hi-hat stand is set up also by causing the pointed end of the spike rod to abut against the floor surface.

However, according to the supporting leg structure disclosed in U.S. Pat. No. 5,408,913, since the bass drum is set by setting the distal end of the leg part against the floor surface, vibration of the bass drum is transmitted to the floor surface via the distal end of the leg part without being absorbed in the rubber leg. Thus, the vibration of the bass drum cannot be educed to its maximum, and sound inherent to the bass drum cannot be obtained sufficiently. Further, also in the supporting leg structure disclosed in U.S. Pat. No. 6,031,170, since the spike rod is assembled to the supporting leg main part, vibration of a hi-hat is transmitted to the floor surface from the supporting tube of the hi-hat stand via the supporting leg main part and the spike rod. Thus, it has the same problem as the supporting leg structure in U.S. Pat. No. 5,408,913.

SUMMARY OF THE INVENTION

Accordingly, it is an objective of the present invention to provide a spiked leg for being attached to a musical instrument or a musical instrument stand, a musical instrument with a spiked leg, and a musical instrument stand with a spiked leg.

To achieve the foregoing objective and in accordance with a first aspect of the present invention, a spiked leg for being attached to a musical instrument or a musical instrument stand is provided. The spiked leg includes a leg member to be coupled to the musical instrument or the musical instrument stand, a stopper fixed to a distal end of the leg member, and a spike supported by the stopper. The stopper is adapted to contact a set-up surface for the musical instrument or the musical instrument stand. The spike is adapted to abut against the set-up surface. A proximal end of the spike is separated from the distal end of the leg member.

In accordance with a second aspect of the present invention, a musical instrument including a spiked leg is provided. The spiked leg includes a leg member to be coupled to the musical instrument, a stopper fixed to a distal end of the leg member, and a spike supported by the stopper. The stopper is adapted to contact a set-up surface for the musical instrument. The spike is adapted to abut against the set-up surface. A proximal end of the spike is separated from the distal end of the leg member.

In accordance with a third aspect of the present invention, a musical instrument stand having a spiked leg is provided. The musical instrument stand includes a supporting tube, a leg member to be coupled to the supporting tube, a stopper fixed to a distal end of the leg member, and a spike supported by the stopper. The stopper is adapted to contact a set-up surface for the musical instrument stand. The spike is adapted to abut against the set-up surface. A proximal end of the spike is separated from the distal end of the leg member.

DETAILED DESCRIPTION OF THE PREFERRED EMBODIMENTS

Hereinbelow, one embodiment in which a spiked leg of the present invention is adapted to a bass drum will be described with reference to FIGS. 1 to 7B.

Figure 1:
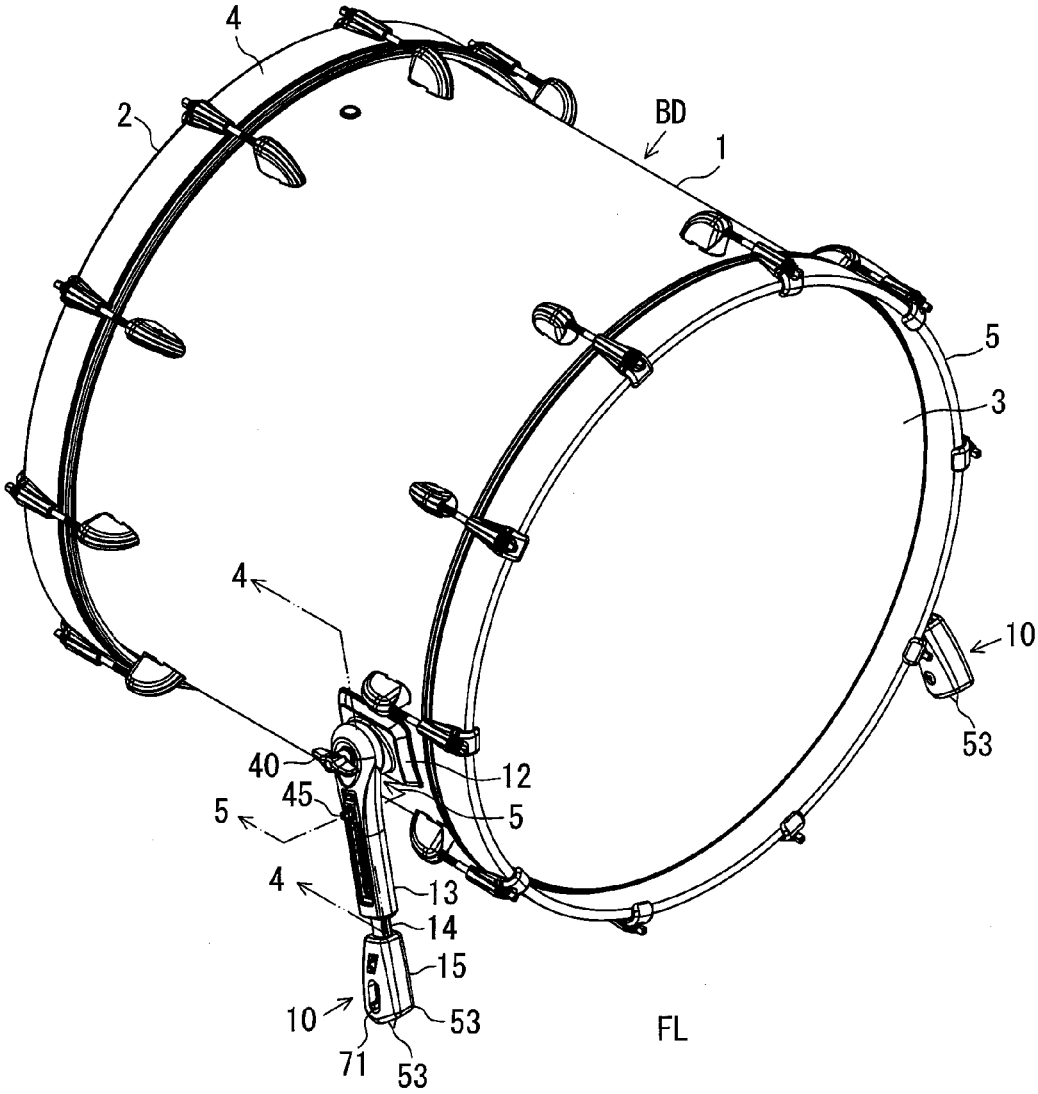
FIG. 1 is a perspective view of a bass drum including spiked legs according to the present invention.

As shown in FIG. 1, a bass drum BD includes a cylindrical shell 1, a batter head 2, a front head 3, a batter hoop 4, and a front hoop 5. The batter hoop 4 is attached together with the batter head 2 to a first opening end of the shell 1. The front hoop 5 is attached together with the front hoop 5 to a second opening end of the shell 1.

A pedal device (not shown) is connected to a part in the vicinity of the batter head 2 of the bass drum BD. Further, a pair of spiked legs 10 is attached at a part in the vicinity of the front head 3 of the bass drum BD. The spiked legs 10 are configured to assume an accommodated position having their distal ends arranged toward the batter head 2 and a use position having their distal ends arranged obliquely forward as shown in FIG. 1. The pair of spiked legs 10 is used in a state of being slightly extended outward from the shell 1. The bass drum BD is set up on a floor surface FL as a set-up surface by being supported at three points by the pair of spiked legs 10 and the pedal device.

Next, the configuration of the spiked legs 10 will be described with reference to FIGS. 1 to 7B.

As shown in FIG. 1, each spiked leg 10 includes a base 12 to be fixed to the shell 1, first and second leg parts 13 and 14 as leg members, and a stopper 15 to be fixed to the distal end of the second leg part 14. The first leg part 13 is attached to the base 12. Further, the second leg part 14 is attached to the first leg part 13. The stopper 15 functions to prevent slippage by contacting the floor surface FL.

Figure 2:
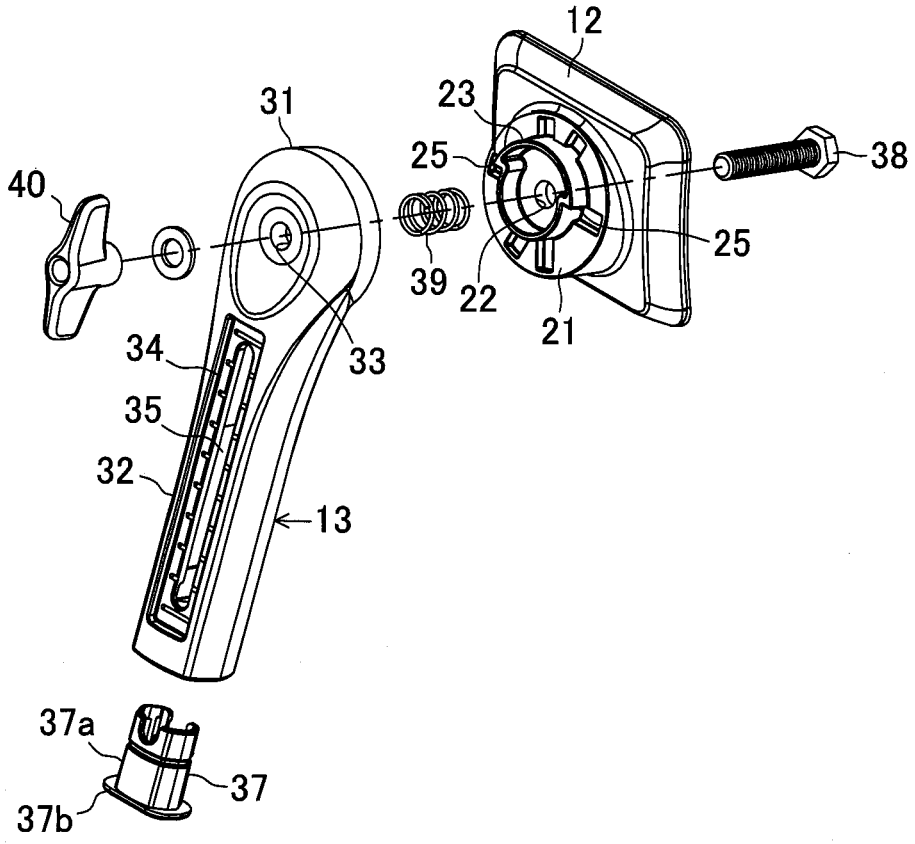
FIG. 2 is an exploded perspective view of parts including a first leg part of the spiked leg.
Figure 4:
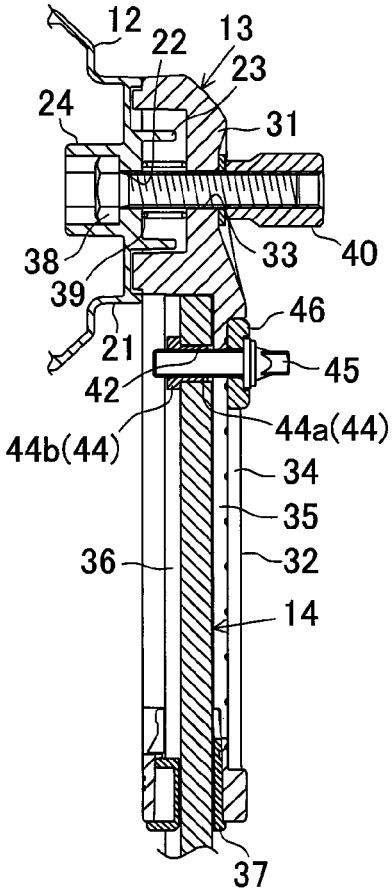
FIG. 4 is a partial cross-sectional view taken along line 4-4 in FIG. 1.

As shown in FIGS. 2 and 4, the base 12 is configured of a box housing having a trapezoid cross-sectional shape. A substantially circular retainer 21, to which the first leg part 13 is attached, is formed at a center of the base 12. The retainer 21 protrudes from a surface of the base 12 by a predetermined height. An insertion hole 22 is formed at a center of the retainer 21. Further, cylindrical walls 23 and 24 are formed around the insertion hole 22 respectively on front and back surfaces of the retainer 21. A pair of restricting sections 25 that restricts the spiked leg 10 from rotating beyond the accommodated position or the use position is provided on the cylindrical wall 23 on a front side of the base 12.

The first leg part 13 is provided with an attaching section 31 to be attached to the base 12 and a substantially cylindrical leg section 32 that extends linearly from the attaching section 31. An insertion hole 33 corresponding to the insertion hole 22 of the base 12 is formed at a center of the attaching section 31. The first leg part 13 is rotationally attached to the base 12 by attaching the attaching section 31 to the retainer 21. Further, a bolt 38 is inserted from the back surface of the base 12 into the respective insertion holes 22 and 33 of the retainer 21 and the attaching section 31.

A spring 39 is arranged between the retainer 21 and the attaching section 31 in a compressed state. A shaft section of the bolt 38 is inserted inside the spring 39. A head section of the bolt 38 is housed in the cylindrical wall 24 on the back of the base 12. The distal end of the bolt 38 protrudes outward from the attaching section 31. A wing nut 40 is threaded to the distal end of the bolt 38.

When the wing nut 40 threaded to the bolt 38 is tightened against an urging force of the spring 39, the first leg part 13 is fixed to the base 12. In contrast, when the wing nut 40 is loosened, the first leg part 13 is urged outward by the spring 39 and can be rotated with respect to the base 12. By operating the wing nut 40 as above and causing the first leg part 13 to rotate, the position of the spiked leg 10 is switched to one of the accommodated position and the use position.

A recess 34 having substantially the same length as the leg section 32 is formed on a surface of the leg section 32. A groove 35 having substantially the same length as the recess 34 is formed on a bottom wall of the recess 34. Scales are engraved on the bottom wall of the recess 34 at regular intervals along both side edges of the groove 35. The leg section 32 includes a space 36 for accommodating the second leg part 14 on an opposite side from the recess 34. A substantially cylindrical guide bushing 37 is attached to the opening end of the leg section 32.

Figure 3:
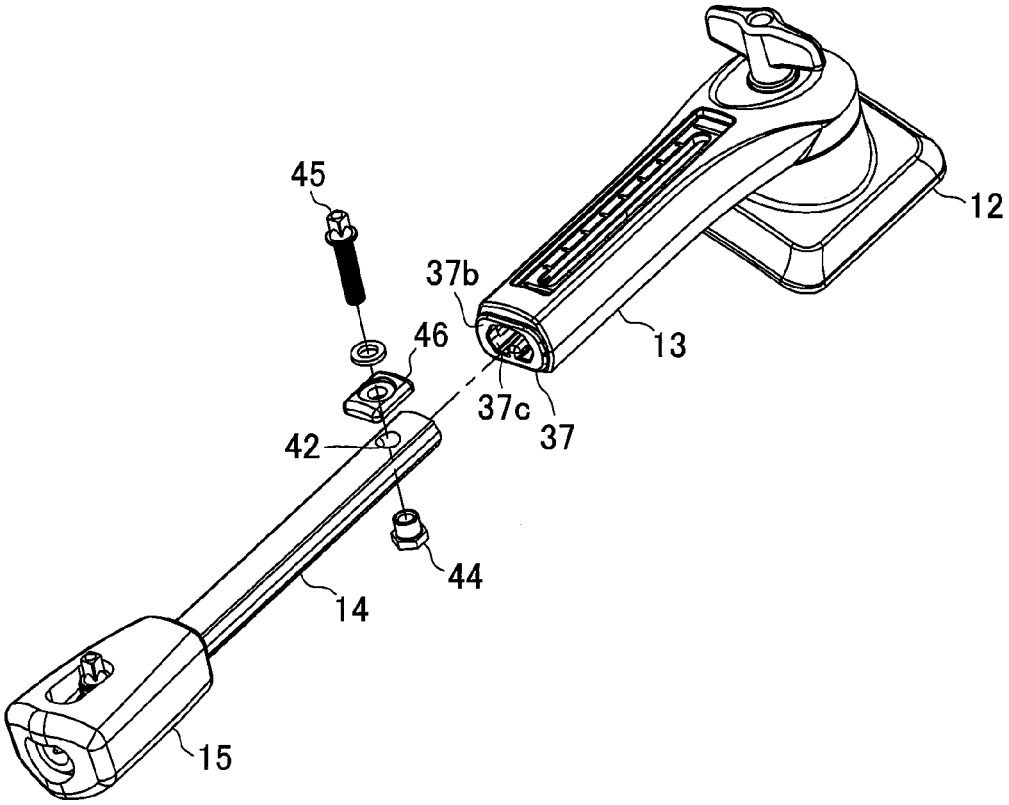
FIG. 3 is an exploded perspective view of parts including a second leg part of the spiked leg.

As shown in FIGS. 2 and 3, the guide bushing 37 is provided with a tubular section 37*a* and a flange section 37*b* provided along an opening end of the tubular section 37*a*. An opening 37*c* having a substantial C-shape is provided at the opening end of the guide bushing 37 together with the flange section 37*b*. The flange section 37*b* and the opening 37*c* are arranged on an outer side than the opening end of the leg section 32 under a state in which the guide bushing 37 is attached to the leg section 32.

Figure 5:
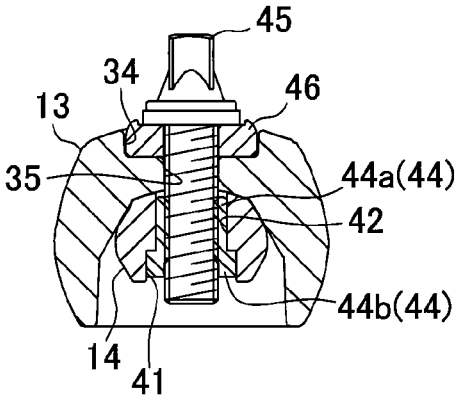
FIG. 5 is a partial cross-sectional view taken along line 5-5 in FIG. 1.
Figure 6:
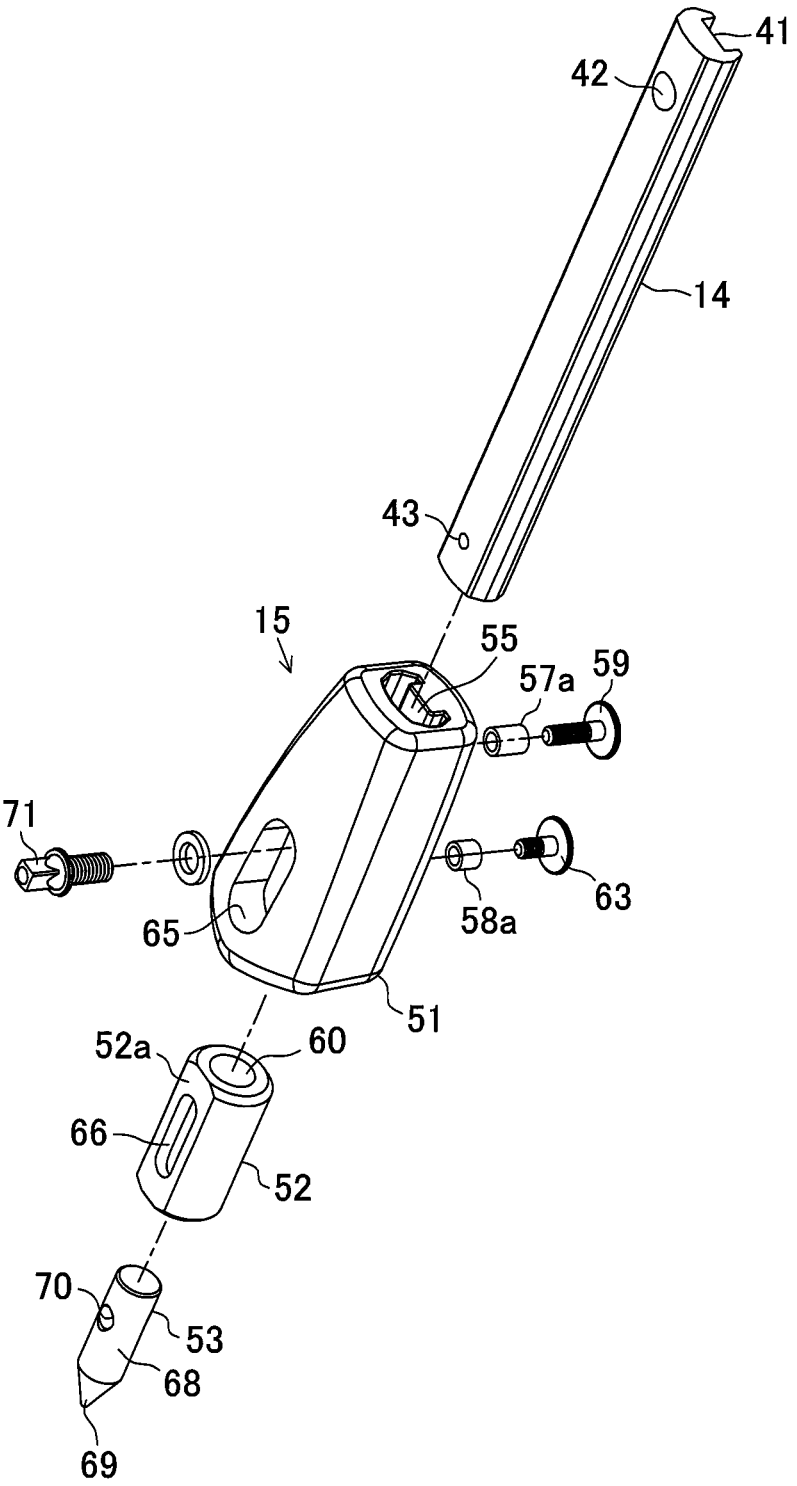
FIG. 6 is an exploded perspective view of parts including a stopper of the spiked leg.

As shown in FIGS. 5 and 6, the second leg part 14 is formed with a substantially C-shaped cross section. Due to this, a groove 41 with a rectangular shaped cross section is formed on the back surface of the second leg part 14. An inserting hole 42 is formed in the vicinity of an upper end of the second leg part 14. Further, a threaded hole 43 is formed in the vicinity of a lower end of the second leg part 14.

As shown in FIGS. 3 to 5, the second leg part 14 is inserted into the guide bushing 37 and is movably accommodated in the space 36 within the first leg part 13. A cylinder section 44*a* of a bushing nut 44 is inserted into the inserting hole 42 of the second leg part 14. A hexagonal portion 44*b* of the bushing nut 44 is fitted into the groove 41 of the second leg part 14. Due to this, the bushing nut 44 is supported so as not to rotate with respect to the second leg part 14.

Further, a bolt 45 is inserted into an inserting hole 42 of the second leg part 14. The bolt 45 passes through the groove 35 from the recess 34 of the first leg part 13 and is threaded to the bushing nut 44. A retaining plate 46 is inserted between the head of the bolt 45 and the bottom wall of the recess 34. When the bolt 45 threaded to the bushing nut 44 is tightened, the first leg part 13 is sandwiched by the second leg part 14 and the retaining plate 46, whereby the second leg part 14 is fixed to the first leg part 13. In contrast, when the bolt 45 threaded to the bushing nut 44 is loosened, the second leg part 14 is movable with respect to the first leg part 13 by the sandwiching of the first leg part 13 by the second leg part 14 and the retaining plate 46 being released. A length of the spiked leg 10 is adjusted by operating the bolt 45 as above and moving the second leg part 14 along its longitudinal direction.

Figure 7B:
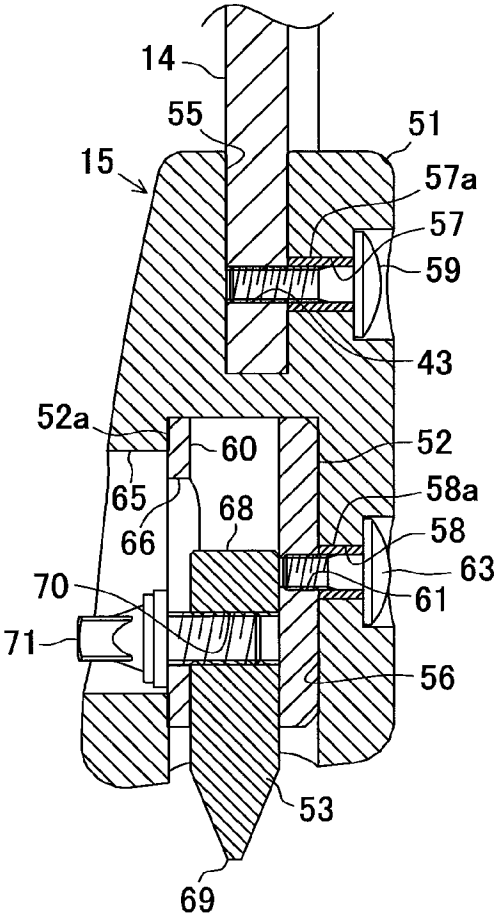
FIG. 7B is a partial cross-sectional view showing a state in which the spike protrudes out from the stopper main body.

As shown in FIGS. 6 to 7B, the stopper 15 is provided with a stopper main body 51 with a substantially rectangular parallelepiped shape, a cylindrical spike holder 52, and a substantially rod shaped spike 53. The stopper main body 51 is formed of a vibration absorbing material such as rubber. A first longitudinal hole 55 in which the distal end of the second leg part 14 is fixed is formed at an upper portion of the stopper main body 51. The first longitudinal hole 55 is formed in a substantial C-shape, similar to the cross-sectional shape of the second leg part 14.

A second longitudinal hole 56, which accommodates the spike holder 52, is formed at a lower portion of the stopper main body 51. The second longitudinal hole 56 is formed with a substantially round shaped cross section, similar to the outer appearance of the spike holder 52. Communicating holes 57 and 58 that respectively communicate with the first and second longitudinal holes 55 and 56 from an outer surface of the stopper main body 51 are formed on the stopper main body 51. Cylindrical collars 57*a* and 58*a* are respectively attached to the communicating holes 57 and 58. A bolt 59 as a first fixing member is threaded to the threaded hole 43 of the second leg part 14 through the collar 57*a* from a lateral side of the stopper main body 51. Due to this, the distal end of the second leg part 14 is fixed to the first longitudinal hole 55 of the stopper main body 51.

The spike holder 52 is located between the spike 53 and a wall surface of the second longitudinal hole 56. The spike holder 52 is made of a material having rigidity, such as metal, ceramics, and plastic. The entire length of the spike holder 52 is set slightly shorter than the entire length of the second longitudinal hole 56. The spike holder 52 includes a supporting hole 60 for supporting the spike 53 at its center. A threaded hole 61 is formed at a center of the spike holder 52 in the longitudinal direction. A bolt 63 as a second fixing member is threaded to the threaded hole 61 of the spike holder 52 through the collar 58*a* from the lateral side of the stopper main body 51. Due to this, the spike holder 52 is fixed to the second longitudinal hole 56 of the stopper main body 51.

The stopper main body 51 includes a communicating hole 65, which communicates with the second longitudinal hole 56 from the outer surface of the stopper main body 51 on an opposite side from the first and second communicating holes 57 and 58. The spike holder 52 also includes a communicating hole 66, which communicates with the supporting hole 60 from the outer surface of the spike holder 52 on an opposite side from the threaded hole 61. Both communicating holes 65 and 66 extend in the longitudinal direction of the stopper main body 51 and the spike holder 52. The communicating hole 66 of the spike holder 52 has a width and a length corresponding to the communicating hole 65 of the stopper main body 51.

The spike 53 is provided with a columnar section 68 and a pointed distal end 69 to abut against the floor surface FL. The spike 53 is accommodated in the supporting hole 60 of the spike holder 52. Further, the spike 53 is supported to be movable along an axis of the spike 53 with respect to the spike holder 52. The spike 53 is exposed from the second longitudinal hole 56 of the stopper main body 51 by moving with respect to the spike holder 52.

A threaded hole 70, which extends in a lateral direction, is formed at substantially a center of the spike 53 in the longitudinal direction. A bolt 71 as an adjusting screw is threaded to the threaded hole 70 through both communicating holes 65 and 66 of the stopper main body 51 and the spike holder 52. The bolt 71 is threaded to the threaded hole 70 by having its head in contact with a flat outer circumferential surface 52*a* of the spike holder 52. Under this state, the head of the bolt 71 is arranged on outer side with respect to the axis of the spike 53.

When the bolt 71 threaded to the threaded hole 70 is tightened, the spike 53 is fixed to the spike holder 52. In contrast, when the bolt 71 threaded to the threaded hole 70 is loosened, the spike 53 is movable with respect to the spike holder 52. A position of the spike 53 with respect to the spike holder 52 is adjusted by operating the bolt 71 as above and by moving the spike 53. The position of the spike 53 with respect to the spike holder 52 corresponds to a protruding amount of the spike 53 from the second longitudinal hole 56.

Next, the internal structure of the stopper 15 will be described with reference to FIGS. 7A and 7B.

Figure 7A:
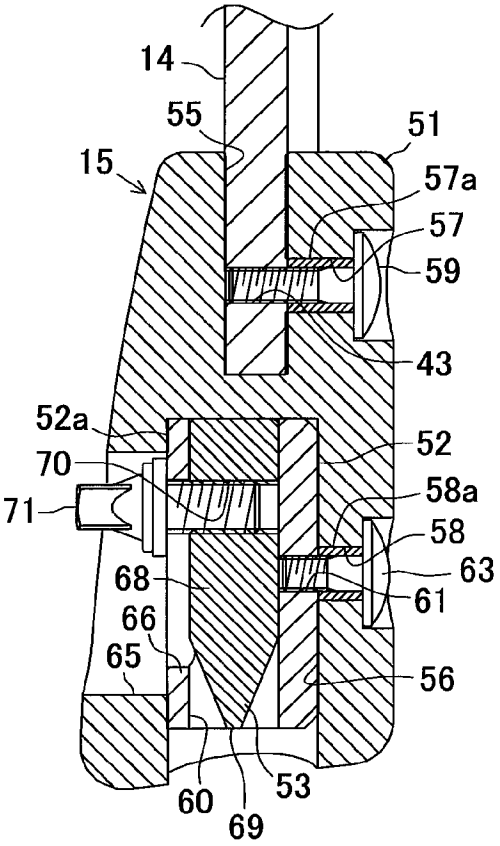
FIG. 7A is a partial cross-sectional view showing a state in which a spike is retracted within a stopper main body.

As shown in FIGS. 7A and 7B, a part of the stopper main body 51 is located between the first longitudinal hole 55 and the second longitudinal hole 56. Due to this, the proximal end of the spike 53 is arranged apart from the distal end of the second leg part 14 under a state in which the second leg part 14 and the spike 53 are assembled onto the stopper 15. That is, a part of the stopper main body 51 formed of the vibration absorbing member is located between the proximal end of the spike 53 and the distal end of the second leg part 14. In the present embodiment, the part of the stopper main body 51 located between the spike 53 and the second leg part 14 functions as the vibration absorbing member that absorbs vibration from the bass drum BD. That is, the vibration absorbing member is formed integrally with the stopper main body 51.

Next, an operating procedure of the above spiked leg 10 will be described with reference to FIG. 1.

As shown in FIG. 1, firstly, the wing nut 40 is loosened, and the spiked leg 10 is rotated to be arranged from the accommodated position to the use position. Thereafter, the wing nut 40 is tightened, and the spiked leg 10 is fixed at the use position. Next, the bolt 45 is loosened, and the length of the spiked leg 10 is adjusted by moving the second leg part 14 relative to the first leg part 13. Thereafter, the bolt 45 is tightened, and the length of the spiked leg 10 is fixed. Next, the bolt 71 is loosened, and the spike 53 is caused to protrude from the stopper main body 51. Then, after having adjusted the protruding amount of the spike 53, the bolt 71 is tightened. The above series of operation is performed for each of the pair of spiked legs 10 on left and right sides upon the setup of the bass drum BD. Upon shifting the spiked leg 10 from the used configuration to the accommodated configuration, an operation opposite to the above series of operation is performed.

Next, operation of the above spiked leg 10 will be described with reference to FIGS. 7A and 7B.

As shown in FIGS. 7A and 7B, a part of the stopper main body 51 is located between the proximal end of the spike 53 and the distal end of the second leg part 14. In this case, since the proximal end of the spike 53 is separated from the distal end of the second leg part 14, the vibration from the bass drum BD is blocked between the proximal end of the spike 53 and the distal end of the second leg part 14. Further, the vibration from the bass drum BD is absorbed by the stopper main body 51 located between the proximal end of the spike 53 and the distal end of the second leg part 14. Due to this, the vibration from the bass drum BD is inhibited from being transmitted to the floor surface FL via the spike 53.

Thus, according to the present embodiment, advantages as follows are achieved.

(1) Since the proximal end of the spike 53 is separated from the distal end of the second leg part 14, the vibration from the bass drum BD is blocked between the distal end of the second leg part 14 and the proximal end of the spike 53. Due to this, the vibration from the bass drum BD is inhibited from being transmitted to the floor surface FL via the spike 53. Thus, the vibration of the bass drum BD is educed to its maximum, and sound inherent to the bass drum BD is obtained.

(2) The part of the stopper main body 51 is located between the proximal end of the spike 53 and the distal end of the second leg part 14. Further, the stopper main body 51 is formed of the vibration absorbing material such as rubber. According to this configuration, the vibration from the bass drum BD is absorbed by the stopper main body 51 located between the proximal end of the spike 53 and the distal end of the second leg part 14. Due to this, the vibration from the bass drum BD is reliably blocked between the distal end of the second leg part 14 and the proximal end of the spike 53. Thus, the vibration from the bass drum BD is reliably inhibited from being transmitted to the floor surface FL via the spike 53.

(3) Since the stopper main body 51 is made of a vibration absorbing material such as rubber, the vibration from the bass drum BD is absorbed by the entirety of the stopper 15. Thus, the vibration from the bass drum BD is reliably inhibited from being transmitted to the floor surface FL via the spike 53.

(4) Since the vibration absorbing member is formed integrally with the stopper main body 51, the number of components of the spiked leg 10 can be reduced. Thus, the number of steps of assembly of the spiked leg 10 and cost of the components can be reduced.

(5) The distal end of the second leg part 14 is fixed to the first longitudinal hole 55 of the stopper main body 51 by the bolt 59, and the spike holder 52 is fixed to the second longitudinal hole 56 of the stopper main body 51 by the bolt 63. Further, the spike holder 52 made of the rigid material is located between the spike 53 and the wall surface of the second longitudinal hole 56. According to this configuration, the fixation of the second leg part 14 to the stopper main body 51 and the fixation of the spike holder 52 are performed respectively by different bolts 59 and 63. Due to this, the strength of the stopper 15 as a whole is ensured, and therefore the posture of the bass drum BD set up on the floor surface FL is stabilized. Further, the second leg part 14 is prevented from coming off the stopper main body 51 and the spike 53 from coming off by the pedaling operation of the player.

(6) The guide bushing 37 having the substantially C-shaped opening 37*c* is attached to the opening end of the leg section 32. Further, the second leg part 14 is formed with the substantially C-shaped cross section, is inserted into the guide bushing 37, and is accommodated in the space 36 within the first leg part 13. Further, the first longitudinal hole 55, in which the distal end of the second leg part 14 is fixed, is formed at the upper portion of the stopper main body 51. The first longitudinal hole 55 is formed in the substantial C-shape, similar to the cross-sectional shape of the second leg part 14. According to this configuration, the second leg part 14 is attached to the distal end of the first leg part 13 so as not to rotate, and the stopper 15 is attached to the distal end of the second leg part 14 so as not to rotate. Further, the bolt 71 is threaded to the threaded hole 70 of the spike 53 by having its head in contact with the flat outer circumferential surface 52*a* of the spike holder 52. In this case, the bolt 71 is arranged with its head always facing the outer side of the shell 1. Due to this, the head of the bold is prevented from contacting the surface of the shell 1 and causing scratches when the spiked leg 10 is arranged at the accommodated position. Further, since the head of the bolt 71 is arranged to always face the outer side of the shell 1, the operation such as screwing the bolt 71 can be performed from outside the bass drum BD. Thus, the protruding amount of the spike 53 from the second longitudinal hole 56 can easily be adjusted.

(7) The bolt 59 is threaded to the threaded hole 43 of the second leg part 14 through the collar 57*a*. Similarly, the bolt 63 is threaded to the threaded hole 61 of the spike holder 52 through the collar 58*a*. Further, the stopper main body 51 is made of a vibration absorbing material such as rubber. According to this configuration, by attaching the collars 57*a* and 58*a* respectively to the communicating holes 57 and 58, the stopper main body 51 is prevented from being crushed by tightening of the bolts 59 and 63.

The present embodiment may be modified as follows.

In the present embodiment, the spiked leg 10 may be adapted to a musical instrument other than the bass drum BD, or to a musical instrument stand such as a cymbal stand or a tom stand.

Figure 8:
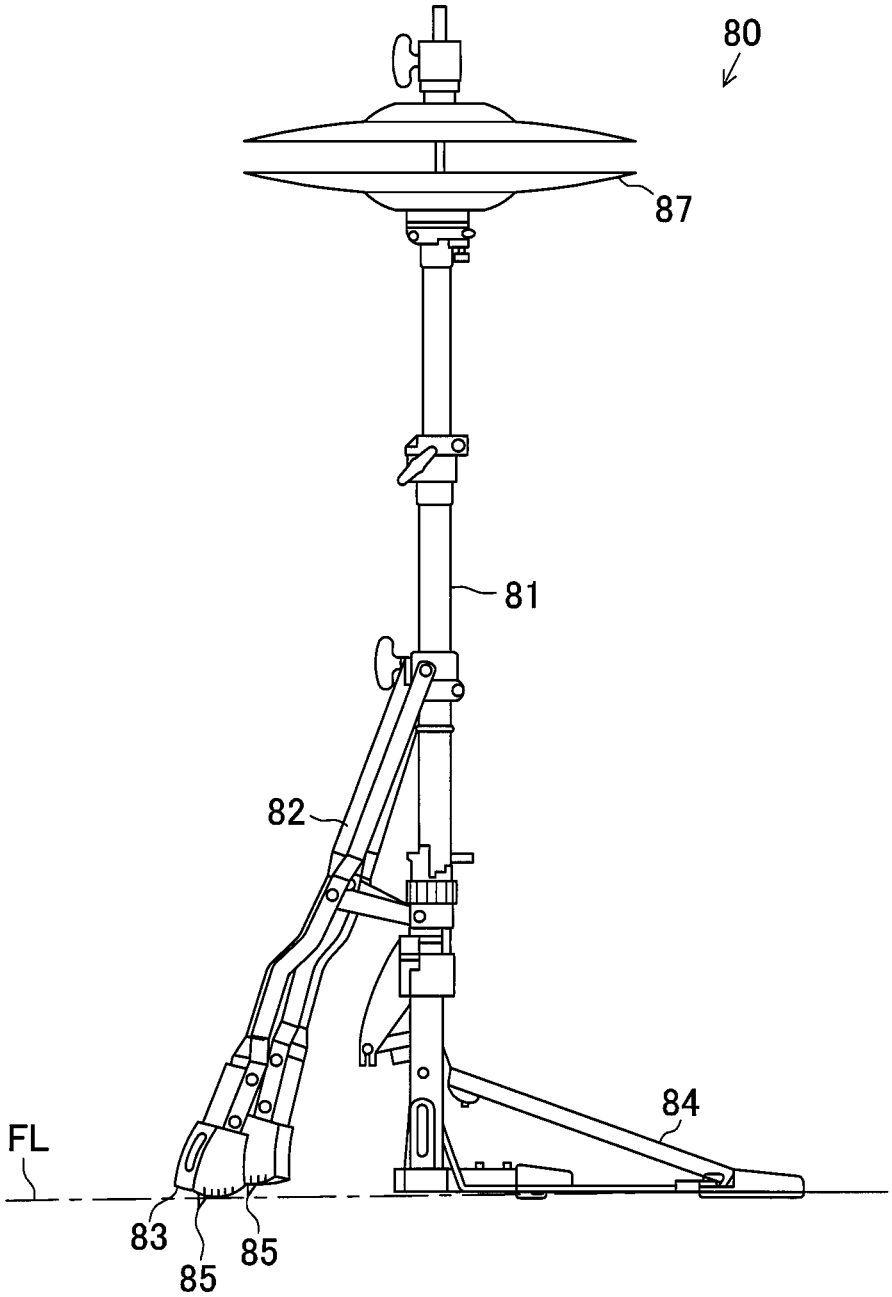
FIG. 8 is a perspective view of a hi-hat stand including a spiked leg of the present invention.

For example, a hi-hat stand 80 shown in FIG. 8 is provided with a supporting tube 81, two leg members 82 coupled to the supporting tube 81, three stoppers 83 to contact the floor surface FL, and a pedal device 84. Each stopper 83 is fixed to the distal end of corresponding leg member 82. A spike 85, which abuts against the floor surface FL, is provided on the stopper 83. Since the internal structure of the stopper 83 is identical to that of the spiked leg 10 of the present embodiment, the detailed description thereof is not repeated here.

As shown in FIG. 8, in the hi-hat stand 80 provided with the spiked legs 10 of the present embodiment also, the proximal ends of the spikes 53 are arranged apart from the distal ends of the leg members 82, as shown in FIGS. 7A and 7B. Due to this, vibration from a hi-hat 87 is inhibited from being transmitted to the floor surface FL via the supporting tube 81, the leg members 82, and the spikes 53. Thus, the vibration of the hi-hat 87 is educed to its maximum, and sound inherent to the hi-hat 87 is obtained.

In the present embodiment, the separating distance between the proximal end of the spike 53 and the distal end of the second leg part 14 may be changed to any value in accordance with the entire length of the stopper main body 51.

In the present embodiment, as the vibration absorbing member to be located between the proximal end of the spike 53 and the distal end of the second leg part 14, a space may be provided, or another member may be used instead of a part of the stopper main body 51. In the former case, a hole or a recess may be formed between the first longitudinal hole 55 and the second longitudinal hole 56 of the stopper main body 51. In the latter case, a member other than the stopper main body 51 may be arranged between the first longitudinal hole 55 and the second longitudinal hole 56 of the stopper main body 51.

In the present embodiment, the stopper main body 51 may be formed by a vibration absorbing member other than rubber. As the vibration absorbing member other than rubber, for example, resin such as rigid polyurethane foamed material, ceramics such as carbon, or wood and the like may be employed.

In the present embodiment, the second leg part 14 and the spike holder 52 may be fixed to the stopper main body 51 by a method other than screw fixation by the bolts 59 and 63. As the method other than screw fixation, for example, fixation by adhesion, fixation by fitting and the like may be employed.

In the present embodiment, the spike holder 52 may be omitted from the stopper 15. Further, the function for adjusting the protruding amount of the spike 53 by operating the bolt 71 may be omitted from the stopper 15.

In the present embodiment, although the leg member of the spiked leg 10 is configured of two leg parts of the first and second leg parts 13 and 14, it may be configured of only one leg part.

The invention claimed is:

1. A spiked leg for being attached to a musical instrument or a musical instrument stand, the spiked leg comprising:

a leg member to be coupled to the musical instrument or the musical instrument stand;

a stopper fixed to a distal end of the leg member, wherein the stopper is formed of rubber and is adapted to contact a set-up surface for the musical instrument or the musical instrument stand;

a spike accommodated in a longitudinal hole of the stopper, wherein the spike has a proximal end and a distal end, the proximal end of the spike is opposite to the distal end of the spike, the proximal end of the spike is closer to the leg member than the distal end of the spike, and the distal end of the spike is adapted to abut against the set-up surface, and a cylindrical holder located between a wall surface of the longitudinal hole and the spike, wherein the cylindrical holder is rigid and is fitted in the longitudinal hole, the longitudinal hole has a distal opening at a lower end of the stopper, and a cross-sectional shape of the distal opening is approximately the same as that of the cylindrical holder to permit the cylindrical holder to be installed in the stopper through the distal opening, the proximal end of the spike is spaced apart from the distal end of the leg member, and a part of the stopper is located between the proximal end of the spike and the distal end of the leg member, the spike and the cylindrical holder form a unit, and the cylindrical holder is spaced apart from the distal end of the leg member, and the part of the stopper is located between the holder and the distal end of the leg member, to prevent direct contact between the leg member and the unit for limiting transmission of vibrations between the leg member and the unit.

2. The spiked leg according to claim 1, wherein the stopper includes a first longitudinal hole, in which the distal end of the leg member is fixed, and a second longitudinal hole, in which the spike is accommodated, and the distal end of the leg member is fixed in the first longitudinal hole by a first fixing member, and the holder is fixed in the second longitudinal hole by a second fixing member.

3. The spiked leg according to claim 1, wherein the spike is supported to be movable along an axis of the spike with respect to the stopper, the stopper includes an adjusting screw for adjusting a position of the spike with respect to the stopper, and a head of the adjusting screw is arranged toward outside of the musical instrument or the musical instrument stand.

4. The spiked leg according to claim 1, wherein the spiked leg is attached to the musical instrument, the leg member is coupled to the musical instrument, and the set up surface is for the musical instrument.

5. The spiked leg according to claim 1, wherein the spiked leg is attached to the musical instrument stand, the leg member is coupled to the musical instrument stand, and the set up surface is for the musical instrument stand.

6. A spiked leg adapted for attachment to a musical instrument or a musical instrument stand, the spiked leg comprising:

a leg member adapted to be coupled to the musical instrument or the musical instrument stand;

a stopper fixed to a distal end of the leg member, wherein the stopper is formed of rubber and is adapted to contact a set-up surface;

a spike accommodated in a longitudinal hole of the stopper, wherein the spike has a proximal end and a distal end, the proximal end of the spike is opposite to the distal end of the spike, the proximal end of the spike is closer to the leg member than the distal end of the spike, and a distal end of the spike is adapted to abut against the set-up surface, and a cylindrical holder located between a wall surface of the longitudinal hole and the spike, wherein the cylindrical holder is rigid and is fitted in the longitudinal hole, the longitudinal hole has a distal opening at a lower end of the stopper, and a cross-sectional shape of the distal opening permits the cylindrical holder to be installed in the stopper through the distal opening, the spike is spaced apart from the leg member, and a part of the stopper is located between the proximal end of the spike and the distal end of the leg member, the spike and the cylindrical holder form a unit, the cylindrical holder is spaced apart from the distal end of the lea member, and the part of the stopper is located between the holder and the distal end of the leg member, to prevent direct contact between the leg member and the unit for limiting transmission of vibrations between the leg member and the unit.

* * * * *